United States Patent [19]

Elco et al.

[11] 3,975,254

[45] Aug. 17, 1976

[54] FORWARD-REVERSE PULSE CYCLING ANODIZING AND ELECTROPLATING PROCESS POWER SUPPLY

[75] Inventors: Richard A. Elco, Pittsburgh; James A. Bauer, Murrysville, both of Pa.; Willard E. Treese, Walnut Creek, Calif.

[73] Assignee: Westinghouse Electric Corporation, Pittsburgh, Pa.

[22] Filed: Aug. 13, 1974

[21] Appl. No.: 497,174

[52] U.S. Cl. ..... 204/228; 204/DIG. 9

[51] Int. Cl.[2] ..... C25D 5/18; C25D 11/02

[58] Field of Search ..... 204/228, DIG. 9, 58

[56] References Cited

UNITED STATES PATENTS

| | | | |
|---|---|---|---|
| 3,496,087 | 2/1970 | Goodwin | 204/228 |
| 3,597,339 | 8/1971 | Newman et al. | 204/228 |
| 3,616,434 | 10/1971 | Hausner | 204/228 |
| 3,622,804 | 11/1971 | Mitchell, Jr. | 204/228 |
| 3,708,407 | 1/1973 | Newman et al. | 204/228 |

*Primary Examiner*—T. M. Tufariello
*Attorney, Agent, or Firm*—W. A. Elchik

[57] ABSTRACT

A forward-reverse pulse cycling anodizing and electroplating process power supply wherein the forward-reverse cycle time, the ratio of positive to negative pulses during the cycle time, the width of the individual pulses and the voltages of the pulses are controlled. During the cycle time a series of discrete positive pulses are supplied during the first portion of the cycle, followed by a series of discrete negative pulses during the remainder of the cycle. The cycle is then repeated for as long as the power supply is energized. The discrete pulses supplied are portions of sinusoidal current waves. Triggerable unidirectional current conducting devices, disposed between the alternating current power supply and the electroplating load, are triggered into conduction at a selected point by a firing angle control circuit. Using the disclosed electroplating process power supply it is possible to hard anodize copper bearing aluminum alloys without etching.

8 Claims, 4 Drawing Figures

FORWARD-REVERSE PULSE CYCLING ANODIZING AND ELECTROPLATING PROCESS POWER SUPPLY

BACKGROUND OF THE INVENTION

This invention relates to anodizing and electroplating and more particularly to a power supply which supplies current wherein a series of discrete positive current pulses are followed by a series of discrete negative current pulses. In the disclosed invention the cycle time, the ratio of positive to negative pulses, the width of the individual pulses, and the voltage of the pulses is adjustable.

In electroplating metals on a base member from an electrolyte by using direct current there are limitations on the speed of plating and the quality of the electrodeposited metal. It is well known in the prior art that for some metals, electrodeposition from an electrolyte upon a base member is improved by applying first a positive current to render the member cathodic, to deposit an increment of metal from the electrolyte, followed by a negative current of lesser value. Repetition of this cycle will build up for many metals a superior electrodeposit. That is, it has been found that in certain plating processes a more uniform coating of plating metal is achieved by periodically reversing the plating current so that some of the plated metal is periodically depleted from the base member.

Anodizing systems using both positive and negative current pulses have also been found to be advantageous for certain materials. Anodizing is defined as a process of forming oxide films on certain metals and alloys by electrolysis in suitable electrolytes. Essentially the process consists of applying an electric potential to a cell in which the metal being anodized is made the anode or positive electrode. The passage of current through the cell results in oxidizing conditions at the anode which converts the surface of the metal to the oxide. Under suitable conditions the metal on the surfaces transform to an adherent oxide.

Some of the first work done on hard anodic coatings on aluminum used cooled sulfuric acid and oxalic acid. The conditions were such that less aluminum was dissolved during anodizing and this resulted in a denser, less porous, hard deposit. It was found that the porosity of the anodic coating varied with the alloy composition. High strength aluminum formed with copper alloys, such as the 2000 series, would pit during anodizing due to the copper in the alloys.

It is desirable to have an anodizing power supply which permits anodizing of copper bearing aluminum alloys without severe etching.

SUMMARY OF THE INVENTION

The disclosed forward-reverse pulse cycling anodizing and electroplating process power supply makes it possible to anodize high strength aluminum copper alloys with a uniform anodic coating. The disclosed power supply provides a cycle wherein a plurality of discrete positive pulses are followed by a plurality of discrete negative pulses. In the disclosed power supply the forward-reverse cycle time, the ratio of positive to negative pulses during the cycle time, the width of the individual pulses, and the voltage of the pulses are controlled. The disclosed plating equipment provides effective and flexible control over the average positive and negative process time current during the forward-reverse cycle and consists of static solid state devices.

A positive output triggerable device and a negative output triggerable device are connected between the alternating current power supply and the electroplating or anodizing load. A variable cycle time selector is provided for selecting a cycle time, during which a first series of discrete positive pulses followed by a second series of discrete negative pulses are supplied to the electroplating or anodizing load. A ratio controller is connected to the cycle time selector for selecting the ratio of positive current pulses to negative current pulses during each cycle. A firing angle control circuit is provided for selecting the width of the supplied current pulses. A variable transformer is provided for adjusting the magnitude of the current pulses supplied. Ammeters are connected to indicate the average positive cycle current and the average negative cycle current.

It is the object of this invention to provide a power supply for an electroplating or anodizing process wherein the cycle time, the ratio of positive to negative pulses during this cycle time, the width of the individual pulses, and the magnitude of the pulses are adjustable to meet a variety of operating conditions.

It is another object of this invention to provide a power supply for an anodizing process wherein a series of discrete positive current pulses which are a portion of a sinusoidal wave are supplied to the load followed by a plurality of discrete negative partial sinusoidal pulses.

BRIEF DESCRIPTION OF THE DRAWINGS

For a better understanding of the invention reference may be had to the preferred embodiment exemplary of the invention shown in the accompanying drawings in which.

DESCRIPTION OF THE PREFERRED EMBODIMENT

Figure 1:
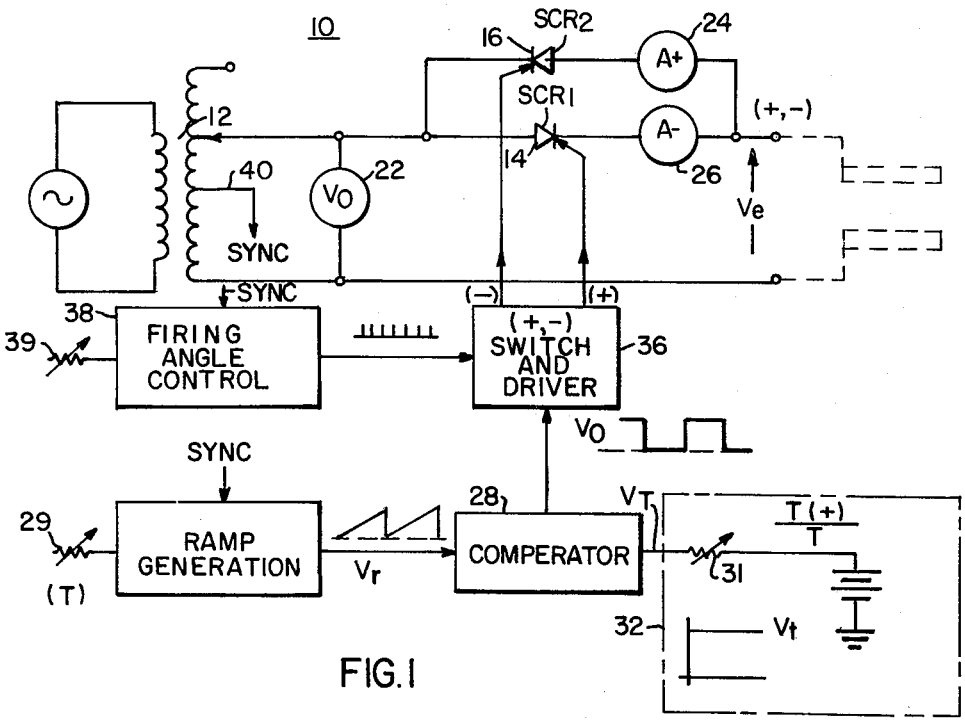
FIG. 1 illustrates a forward-reverse pulse cycling anodizing and electroplating process power supply utilizing the teachings of the present invention.
Figure 2:
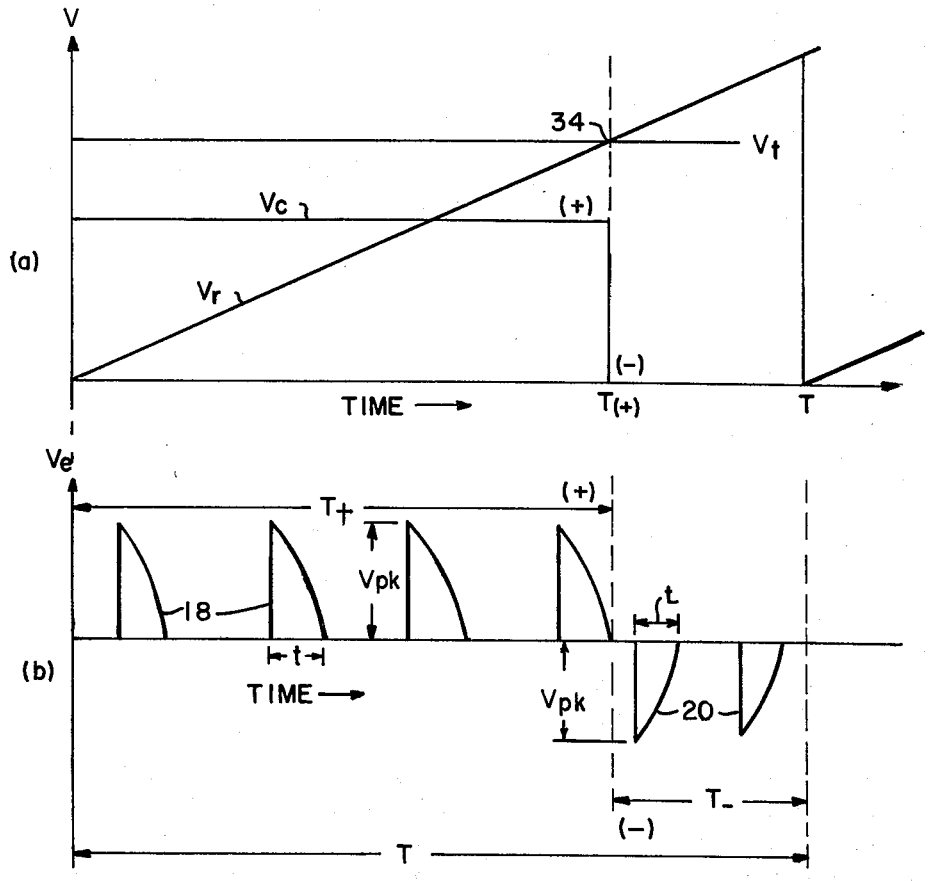
FIG. 2 shows the waveform of the output and the various components utilized in FIG. 1.

Referring now to the drawings and FIGS. 1 and 2 in particular there is shown an anodizing and electroplating process power supply utilizing the teaching of the present invention.

The disclosed forward-reverse pulse cycling anodizing and electroplating process power supply utilizes electronic means for providing controlled forward-reverse pulse cycling for electroplating or anodizing. The controlled parameters are: (1) forward-reverse cycle time, T; (2) the ratio of positive to negative pulses T+/T−, during the cycle time T; (3) the width, $t$, of the individual pulses, and; (4) the peak voltage $V_{pk}$ of the pulses. The process power supply provides effective and flexible control over the average positive and negative process time current during the cycle T, and uses static solid state devices.

Figure 3:
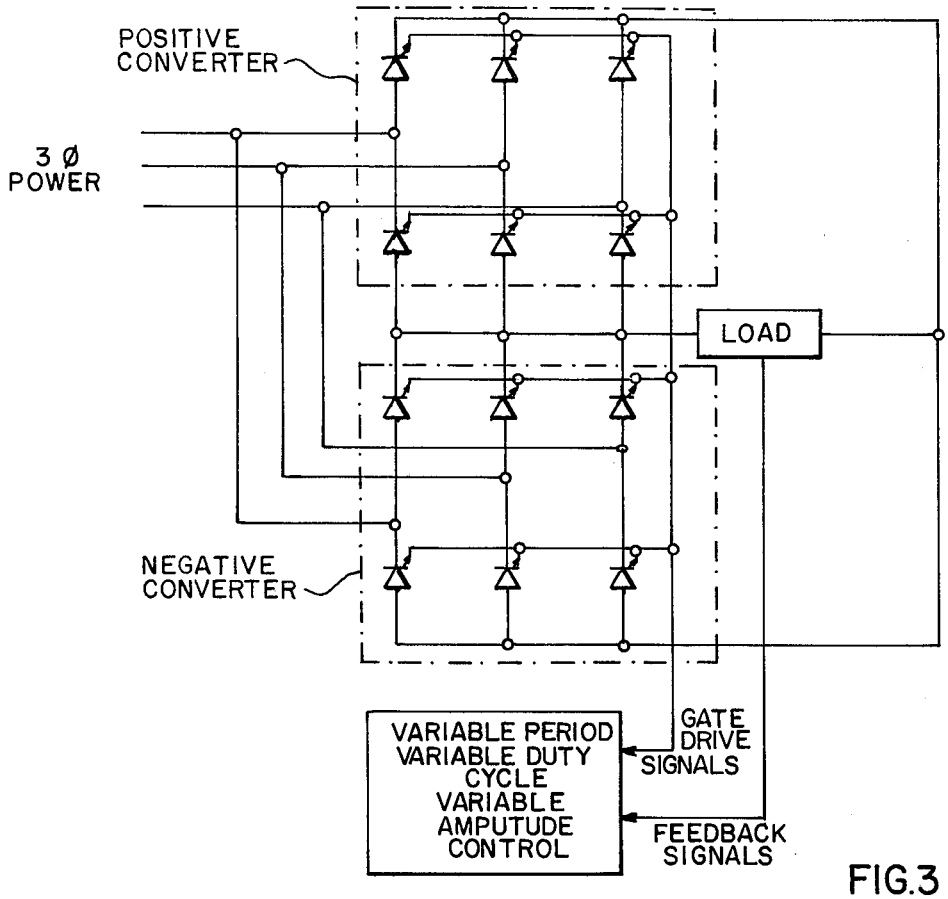
FIG. 3 illustrates a three phase full wave power supply utilizing the teaching of this invention.
Figure 4:
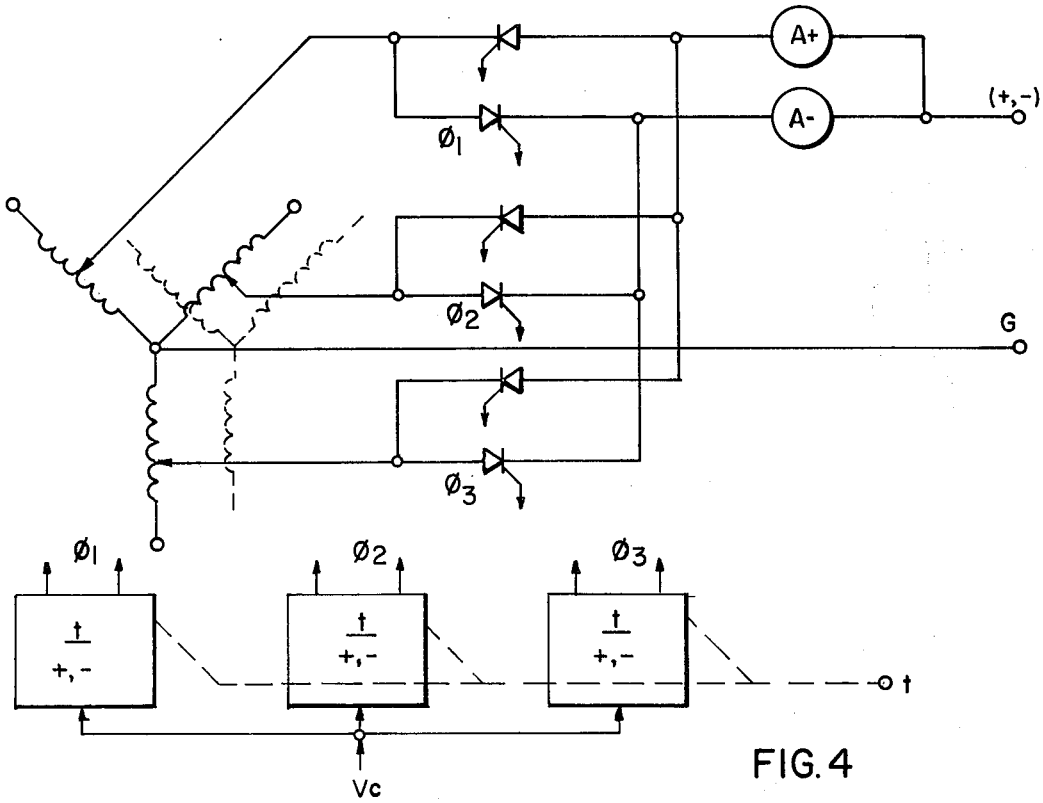
FIG. 4 illustrates a three phase half wave power supply utilizing the teaching of this invention.

FIG. 1 shows the basic circuit of the forward-reverse pulse cycling anodizing and electroplating process power supply for a simple half wave control. The power supply comprises an SCR dual polarity power supply made up of a variable transformer 12 and an SCR 14 for positive output pulses and an SCR 16 for negative output pulses. The positive pulses 18 and the negative pulses 20 are discrete portions of the sinusoidal alternating current input. As shown in FIG. 2, one of the basic control parameters is the forward-reverse cycling time T, which consist of a positive pulse portion $T_+$ and a negative portion $T_-$. Cycle time T can be varied from a fraction of a second to several minutes. The ratio of positive pulses $T_+$ to negative pulses $T_-$ during the cycle time T can also be varied. The firing width, *t*, of the individual partial sinusoidal pulses 18 or 20, and the peak voltage $V_{pk}$ of the pulses is also variable. Instrumentation consisting of an AC voltmeter 22, an ammeter 24 to indicate average positive cycle current, and an ammeter 26 to indicate average negative cycle current also are provided. The power supply can be a half wave single phase supply as shown in FIG. 1 or a half wave multiphase power supply as shown in FIG. 4, or a full wave multiphase power supply as indicated in FIG. 3. For a multiphase power supply firing and polarity switching devices are required for each phase as shown in FIGS. 3 and 4.

The pulse selection, either positive 18 or negative 20 is controlled by a comparator type circuit 28 driven by a process cycle time generator and a pulse ratio generator circuit. These control circuits can be either analog or digital. In an analog version as shown in FIG. 1 the process time generator is a sawtooth ramp generator 30 and the pulse ratio control is a variable DC voltage supply 32. In this embodiment the comparator 28 is a simple zero crossing detector which provides an output $V_C$ to supply trigger pulses to the appropriate SCR 14 and 16 in the power supply. The output of the ramp generator is a ramp voltage $V_R$ as shown in FIG. 2. When the output of the ramp voltage generator $V_R$ exceeds the output $V_T$ of the pulse ratio control 32, indicated at point 34, the output $V_C$ of the comparator 28 changes state and causes the switch end driver 36 to feed the signal from the firing angle control 38 to the negative output SCR 16.

The variable transformer 12 supplies a selected sinusoidal voltage $V_O$ to the SCR's 14 and 16. When only SCR 14 is triggered the output of the supply is a series of partial half wave positive sinusoidal pulses 18 the firing angle or pulse width, *t*, is controlled in the usual manner by conventional firing angle control circuitry 38. The pulse width can be controlled by varying potentiometer 39. When only SCR 16 is being triggered a series of negative pulses 20 is obtained. The function of the switch and driver 36 is to select the SCR which is being triggered by the firing angle controlled circuitry 38. In this manner a string of descrete partial sinusoidal positive current pulses followed by a string of discrete partial sinusoidal negative pulses can be obtained, which follows the state of the (+) or (−) output of the switch and driver 36.

The polarity output, plus (+) or minus (−), of switch and driver 36 is controlled by analog circuits 28, 30 and 32. The output of the comparator 28, which is connected to switch and driver 36, is controlled by the inputs which are a DC control voltage $V_T$, which can be varied by varying potentiometer 31, and a sawtooth ramp voltage $V_R$, which can be varied from a fraction of a second to several minutes by varying potentiometer 29. When the DC control voltage $V_T$ and the ramp voltage $V_R$ are equal the output signal of the comparator 28 changes and hence changes the state of the switch and driver 36. By varying the control voltage $V_T$ the time $T_+$ during which positive pulse 18 are being supplied can be controlled. Since $T_+ + T_- = T$, control can be obtained over the ratio of the number of positive pulses 18 and the number of negative pulses 20 during the cycle time T.

The amplitude of the ramp voltage $V_R$ is fixed but the periods T of the ramp is variable from fractions of a second to several minutes or longer. Conventional time base circuits can be used to provide the timing signal. To insure proper phase locking to firing angle, control circuit 38 and the timing ramp generator 30 are synchronized to the line frequency by a transformer tap 40.

The control circuit and power supply 10 can provide smooth control of the process cycle time and the average positive and negative currents during this cycle T as well as pulse width t of the individual pulses.

The disclosed forward-reverse pulse cycling power supply provides simple precise control over the parameters of pulse cycling anodizing or electroplating processes. This supply is static and can be made all solid state. The controlled pulsing of the partial sinusoidal discrete current pulses during the cycle time T yields improved control over heating at the anodized or plating surface, and fine control over the microstructure of the anodized or plated layer. More uniform anodic coatings were obtained by using the disclosed power supplies than with prior art DC anodizing. The use of the forward-reverse pulse cycling anodizing equipment made it possible to anodize 2000 series hard aluminum alloys successfully, while severe etching often occurred with prior art anodizing. Anodized threaded portions of 2000 series aluminum pipe using the teaching of this invention resulted in smoother more unifrom coatings than is available in the prior art. The use of the disclosed anodizing equipment makes it possible to anodize aluminum alloys with less cleaning than is required for DC anodizing. During tests there was also less dye penetration of the smooth anodized coating, obtained with the disclosed circuit, than with the rougher DC anodized coatings. Anodized coatings obtained using the disclosed forward-reverse pulse cycling has superior abrasion resistance and appearance when compared to prior art DC anodized coating. Usual AC or combined AC-DC anodizing or electroplating methods can be provided by the disclosed process power supply. The variable pulse width t provided by the disclosed supply provides a form of variable frequency control which is sometimes required for successful anodizing or electrodeposition processes.

We claim:

1. An electroplating process power supply for supplying power from an alternating current supply to an electroplating load comprising:

a positive output unidirectional triggerable device disposed between the alternating current supply and the electroplating load;

a negative output unidirectional triggerable device disposed between the alternating current supply and the electroplating load;

cycle time selecting means connected to said positive output unidirectional device and said negative output unidirectional device for selecting a cycle time, independent of current flow through said unidirectional devices, during which a first series of discrete positive current pulses followed by a second series of discrete negative current pulses are supplied to the electroplating load;

ratio control means connected to said cycle time selecting means for selecting the time when the first series of discrete positive pulses ceases and the second series of discrete negative pulses start, thereby controlling the ratio of the positive current pulse supplied to the negative current supplied; and, firing angle control circuit means connected to said positive output unidirectional device or said negative output unidirectional device for selecting the width of each of the first series of pulses and the second series of pulses supplied to the electroplating load.

2. An electroplating process power supply as claimed in claim 1 including:

a variable transformer disposed between the alternating current supply and the electroplating load;

said variable transformer having its input connected to the alternating current supply and its output connected to said positive output unidirectional device and said negative output unidirectional device.

3. An electroplating process power supply as claimed in claim 1 wherein:

said cycle time selecting means comprises a ramp function generator means which generates a ramp output voltage wave;

said ratio controller means comprises a variable direct current output supply; and including, a comparator which compares the ramp function output of said cycle time selecting means with the direct current output of said ratio control means and initiates switching of the output of the firing angle circuit from the positive output unidirection device to the negative output unidirectional device when the value of the output ramp function voltage exceeds the direct current output of the ratio controller means.

4. An electroplating process power supply as claimed in claim 2 including:

a tap on said variable transformer;

a synchronizing connection from said tap on said variable transformer to said firing angle control circuit means and said cycle time selecting means.

5. An electroplating process power supply as claimed in claim 2 including:

a first ammeter for indicating average current flow connected in series with said positive output unidirectional device;

a second ammeter for indicating average current flow connected in series with said negative output unidirectional device; and, a voltmeter connected across the output of said variable transformer.

6. An electroplating process power supply as claimed in claim 1 wherein:

said positive output unidirectional triggerable device comprises a first SCR; and, said negative output unidirectional triggerable device comprises a second SCR.

7. Apparatus for supplying power from an alternating current supply to an anodizing load comprising:

a first unidirectional triggerable current conducting device connected between the alternating current supply and the anodizing load for permitting positive current flow when activated by a trigger signal;

a second unidirectional triggerable current conductive device connected between the alternating current supply and the anodizing load for permitting negative current flow when activated by a trigger signal;

cycle time and switch selector means for selecting a cycle time, independent of current flow through said unidirectional devices, during a first portion thereof trigger signals will be sent to said first unidirectional triggerable device and during the remaining portion thereof trigger signals will be sent to said second unidirectional triggerable device; and, fire angle control means for supplying trigger signals at a selected time of each alternating current to said cycle time and switch selector means.

8. Apparatus for supplying power as claimed in claim 7 wherein said cycle time and switch selector means comprises:

ramp generator means for generating a sawtooth voltage waveform;

ratio control means for supplying a variable DC voltage;

comparator and switching means for comparing the sawtooth output of said ramp generator to the DC output of said ratio controller and switching the trigger signal from said fire angle control means from said first unidirectional triggerable device to said second unidirectional triggerable device when the voltage of the sawtooth waves exceed the voltage of the DC ratio control signal.

* * * * *